United States Patent [19]

Gassen et al.

[11] Patent Number: 5,045,273

[45] Date of Patent: Sep. 3, 1991

[54] METHOD FOR CHEMICAL DECONTAMINATION OF THE SURFACE OF A METAL COMPONENT IN A NUCLEAR REACTOR

[75] Inventors: Rainer Gassen, Fuerth; Horst-Otto Bertholdt, Heroldsbach; Klaus Zeuch, Eckental, all of Fed. Rep. of Germany

[73] Assignee: Siemens Aktiengesellschaft, Munich, Fed. Rep. of Germany

[21] Appl. No.: 396,992

[22] Filed: Aug. 22, 1989

[30] Foreign Application Priority Data

Aug. 24, 1988 [DE] Fed. Rep. of Germany ..... 3828727

[51] Int. Cl.[5] ..... G21C 19/42

[52] U.S. Cl. ..... 376/309; 376/310; 252/626; 252/631

[58] Field of Search ..... 376/310, 309; 252/626, 252/631

[56] References Cited

U.S. PATENT DOCUMENTS

| | | | |
|---|---|---|---|
| 2,852,419 | 9/1958 | Overholz et al. | 134/3 |
| 4,217,192 | 8/1980 | Lerch et al. | 204/149 |
| 4,512,921 | 4/1985 | Anstine et al. | 252/626 |
| 4,587,043 | 5/1986 | Murray et al. | 252/626 |
| 4,654,170 | 3/1987 | Murray | 252/626 |
| 4,690,782 | 9/1987 | Lemmens | 252/626 |
| 4,729,855 | 3/1988 | Murray et al. | 252/626 |
| 4,731,124 | 3/1988 | Bradbury et al. | 134/3 |
| 4,756,768 | 7/1988 | Bertholdt et al. | 134/3 |
| 4,820,473 | 4/1989 | Ohashi et al. | 376/305 |
| 4,839,100 | 6/1989 | Goodall et al. | 252/626 |
| 4,913,849 | 4/1990 | Husain | 252/626 |
| 4,942,594 | 7/1990 | Bertholdt et al. | 376/310 |

FOREIGN PATENT DOCUMENTS

| | | |
|---|---|---|
| 689498 | 11/1986 | Belgium . |
| 2613351 | 3/1976 | Fed. Rep. of Germany . |
| 1483146 | 6/1966 | France . |
| 1109389 | 4/1968 | United Kingdom . |

*Primary Examiner*—Robert L. Stoll
*Assistant Examiner*—Nina Bhat
*Attorney, Agent, or Firm*—Herbert L. Lerner; Laurence A. Greenberg

[57] ABSTRACT

A method for chemical decontamination of the surface of a metal component of a nuclear reactor plant includes treating the surface of the metal component in a single-step method with an aqueous solution that is free of carbonic acid oxalic acid and contains a different carbonic acid.

38 Claims, 1 Drawing Sheet

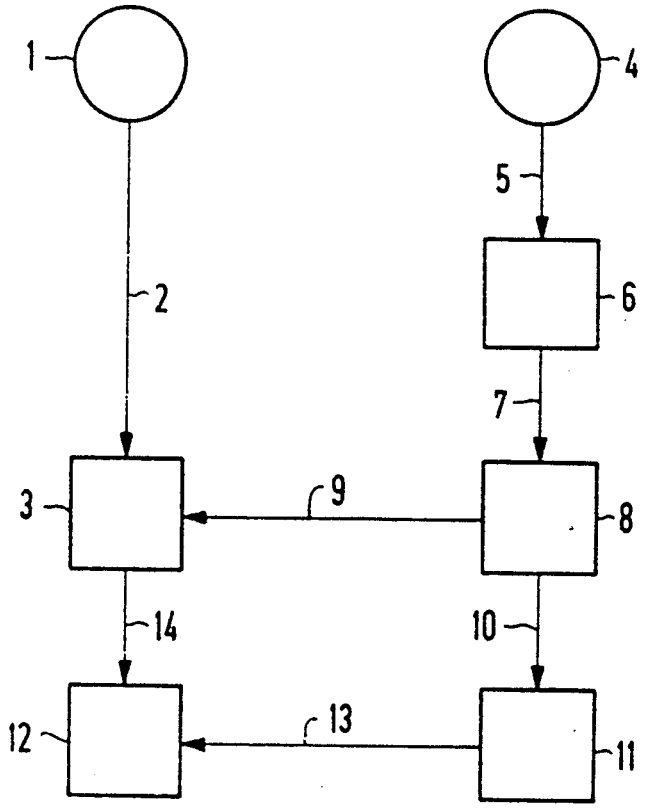
1
4
5
2
6
7
3
9
8
14
10
12
13
11

METHOD FOR CHEMICAL DECONTAMINATION OF THE SURFACE OF A METAL COMPONENT IN A NUCLEAR REACTOR

The invention relates to a method for the chemical decontamination of the surface of a metal component in a nuclear reactor.

In order to reduce the radiation exposure to personnel during inspection, maintenance and repair work on components and circulation systems in pressurized water reactors or boiling water reactors, radioactive oxide films must be removed from the surfaces of the components to be handled or tested. A method of chemical decontamination suitable for this purpose is known, for instance, from German Patent DE-PS 26 13 351. In the known method, the decontamination takes place in two steps or stages Initially, as a first step, an oxidative treatment with an alkaline permanganate solution is performed. The second step provides putting the components in contact with a citrate oxalate solution, in which an essential ingredient is oxalic acid.

All of the other known decontamination methods also proceed in two stages, and oxalic acid is always used to remove deposits, in particular oxide deposits Known decontamination methods, for instance, provide a first stage of oxidation with manganese acid ($HMnO_4$), nitric acid ($HNO_3$) in combination with potassium permanganate ($KMnO_4$), or sodium hydroxide (NaOH) in combination with potassium permanganate ($KMnO_4$). In the second stage, the removal of the oxides from the surface to be decontaminated then takes place. Complexing organic acids are used as reducing agents and often oxalic acid alone is used In all of the other known cases, a mixture of various acids is used, in which oxalic acid is always an essential ingredient.

No methods for chemical decontamination of surfaces of metal components in nuclear reactors that do not use oxalic acid have thus far been disclosed.

However, the use of oxalic acid in a decontamination process is deleterious to the success of the method. For instance, oxalic acid causes an intercrystalline attack on sensitized materials, which, for instance, are present in the region of a weld seam. Moreover, the use of oxalic acid in the presence of heavy metals causes the precipitation of heavy metal oxalates. Thus in the decontamination of components of a nuclear reactor, oxalates of manganese, cobalt, nickel and iron may precipitate out Since these metals contain radioactive isotopes, the precipitation of the oxalates causes a new contamination of the surfaces of the components during the decontamination process. That is, a so-called recontamination takes place. The probability of recontamination is particularly high if the components to be decontaminated are formed of nickel-based alloys, such as Inconel 600.

As a rule the components and systems of a nuclear reactor to be decontaminated are made of different materials. Consequently, different oxides must be removed by the decontamination process. In order to provide a particular decontamination process, each oxide type exhibits a specific loosening behavior. A component, such as a pump housing, that is made of two different materials, such as a nickel-based material and an iron-based material, cannot be optimally decontaminated by any of the known decontamination methods, which always use oxalic acid, if the two cleaning steps are each performed only once. Instead, a separate, specific decontamination process is usually needed for every material present in the component.

It is accordingly an object of the invention to provide a method for chemical decontamination of the surface of a metal component in a nuclear reactor, which overcomes the hereinafore-mentioned disadvantages of the heretofore-known methods of this general type, which is economical, which precludes recontamination from precipitation, which does not attack sensitized materials such as those in the vicinity of weld seams, and which attains uniformly successful decontamination on all materials typical for the metal component to be decontaminated. Furthermore, components made up of a plurality of materials should also be completely decontaminated in only a single use of the method.

With the foregoing and other objects in view there is provided, in accordance with the invention, a method for chemical decontamination of the surface of a metal component of a nuclear reactor plant, which comprises treating the surface of the metal component in a single-step method with an aqueous solution that is free of the carbonic acid oxalic acid and contains a different carbonic acid.

This method has the advantage of avoiding recontamination. Heavy metal salts of carbonic acids other than oxalic acid are much more readily soluble than oxalates. Since only other carbonic acids are used instead of oxalic acid in the method according to the invention, recontamination of the surfaces does not occur. An essential feature is not only the use of carbonic acids other than oxalic acid but also the complete absence of even the smallest proportion of the carbonic acid oxalic acid in the aqueous solution. Carbonic acids other than oxalic acid are capable of dissolving iron oxides as well as nickel oxides, and of keeping them in solution, which is essential. They can then be readily removed. Moreover, as tests have shown, an advantage attained with the method according to the invention is that sensitized materials are not subjected to intercrystalline attack.

A further essential advantage is that the decontamination factor in the use of the method according to the invention is substantially higher than for chemical decontamination with oxalic acid. The decontamination factor is the quotient of the dose rate of a component to be decontaminated before treatment and the dose rate of the same component after the treatment. At the same acid concentration, the method according to the invention has the advantage of attaining much higher decontamination factors than would be possible with the use of oxalic acid, yet without the danger of recontamination from the precipitation of previously dissolved radioactive nuclides onto the cleaned metal surface. Since the method according to the invention is usable with equal success for all materials used in the nuclear field, it is advantageously also possible to decontaminate components and systems being formed of a plurality of materials, such as a pump housing partly made from an iron-based material and partly from a nickel-based material. Even for components formed of only a single material, high decontamination factors are attained with the method according to the invention. In a series of tests under identical conditions, while a decontamination factor of only 140 was attainable with the carbonic acid oxalic acid, other carbonic acids, namely dihydroxytartaric acid in combination with pyridine-2,6-dicarbonic acid, led to a decontamination factor of 650.

Accordingly, with the method according to the invention, surfaces of components made of either a single material or even a plurality of materials can be decontaminated better than was previously possible. Moreover, recontamination from precipitation does not occur. In addition, the resistance of sensitized materials, which are located, for instance, in the vicinity of a weld seam, is not impaired An intercrystalline attack does not occur.

Finally, because the method according to the invention is a single-step method, there is the advantage of being able to dispense with intervening steps, such as rinsing steps, which were necessary in a multistep method. Accordingly, a short decontamination time suffices.

For instance, a carbonic acid that is not oxalic acid is converted by a chemical or thermal process into a further carbonic acid. This conversion can take place directly in the aqueous solution intended for treating the surface. However, the conversion could also take place in a method step preceding the actual decontamination. The conversion of one carbonic acid into a further carbonic acid has the advantage of beginning with an inexpensive carbonic acid, and obtaining a carbonic acid that assures very good decontamination success, but which would be difficult to obtain commercially, either because it is not available or because it is very expensive.

The surface of the component to be decontaminated is, for instance, treated with an aqueous solution that contains at least one ketonic acid. In other examples, the solution may contain at least one hydroxycarbonic acid, or a mixture of at least one ketonic acid and at least one hydroxycarbonic acid. Mesoxalic acid is a particularly suitable ketonic acid. Tartronic acid and dihydroxytartaric acid are particularly suitable hydroxycarbonic acids.

With all of these carbonic acids, the aforementioned advantages of the method according to the invention are particularly clearly attained. Glyoxylic acid and hydroxyacetic acid are also suitable for the method according to the invention.

After acidic preoxidation, as well, better decontamination results are obtained than with oxalic acid; this is carried out, for instance, with tartronic acid, mesoxalic acid and dihydroxytartaric acid.

At least one complexing agent can advantageously be added to the aqueous solution. This markedly improves the decontamination effect of ketonic acids and hydroxycarbonic acids.

A suitable complexing agent is a chelating agent such as ethylenediaminetetraacetic acid (EDTA), diethylenetriaminepentaacetic acid (DTPA) and nitrilotriacetic acid (NTA), or a pyridine carbonic acid, such as 2-picolinic acid or dipicolinic acid.

A particularly good outcome of decontamination is attained, for instance, after alkaline preoxidation, with a ketonic acid or a hydroxycarbonic acid, if this acid is combined with a pyridine carbonic acid as a complexing agent. The decontamination factors then attained are higher than 100. Decontamination factors of up to 650 are attained.

Tables 1 and 2 given below, make reference to examples in the decontamination of austenitic chromium nickel (CrNi) steel and the decontamination of a nickel alloy, they show decontamination factors attainable when the decontamination solutions according to the invention are used, and they also show the factors attainable with the use of oxalic acid for comparison.

| Acids | Decontamination factor |
|---|---|
| Tartronic acid | 110 |
| Dihydroxytartaric acid | 70 |
| Mesoxalic acid | 80 |
| Tartronic acid plus pyridine-2,6-dicarbonic acid | 180 |
| Dihydroxytartaric acid plus pyridine-2,6-dicarbonic acid | 650 |
| Oxalic acid | 140 |
| Oxalic acid, if oxalate is precipitated | 1.7 |

| Acids | Decontamination factor |
|---|---|
| Tartronic acid plus pyridine-2,6-dicarbonic acid | 110 |
| Tartronic acid plus pyridine-2-carbonic acid | 115 |
| Dihydroxytartaric acid plus pyridine-2,6-dicarbonic acid | 175 |
| Oxalic acid | 115 |
| Oxalic acid, if oxalate is precipitated | 7 |

In order to set a particular redox potential, the aqueous solution may, for instance, contain hydrogen peroxide or hypophosphite. This advantageously increases the dissolution speed of various oxide forms in the decontamination solution.

Tartronic acid can only be stored chilled, at temperatures between 0° C. and 4° C. Tartronic acid is also very expensive. It is accordingly provided, for example, that a solution that contains easily storable dihydroxytartaric acid is brought into contact with the surface to be decontaminated, and that this solution is then heated, to form tartronic acid. With tartronic acid and for certain materials, better decontamination is attained than with dihydroxytartaric acid. The advantage is that tartronic acid is produced directly in the decontamination solution from easily stored dihydroxytartaric acid.

Naturally, the tartronic acid may instead be formed from dihydroxytartaric acid by heating in a method step preceding the decontamination. The tartronic acid thus formed is then used for the decontamination.

Although in contrast to tartronic acid, dihydroxytartaric acid is easily stored, it is hardly available in commerce. The dihydroxytartaric acid is therefore preferably produced from its salts, and in particular from its sodium salt, which is obtainable easily and economically.

The mesoxalic acid can also be produced from its salts, particularly its sodium salt.

The aforementioned acids are, for instance, produced from their salts by ion exchange.

Instead of obtaining mesoxalic acid from its salts, it can also be obtained from tartronic acid. To this end, the aqueous decontamination solution that contains tartronic acid, which may already have been produced from dihydroxytartaric acid, has hydrogen peroxide added to it, which leads to the formation of mesoxalic acid from the tartronic acid. The advantage of this is that the mesoxalic acid is also obtained from a salt of the dihydroxytartaric acid. The dihydroxytartaric acid produced from its salt is heated for this purpose, which leads to tartronic acid. Hydrogen peroxide is then added to that acid, which leads to the formation of mesoxalic acid.

The formation of mesoxalic acid from tartronic acid and hydrogen peroxide can, for instance, also take place in a separate vessel, after which the mesoxalic acid formed is introduced into the decontamination solution.

In order to provide decontamination with mesoxalic acid, a solution that contains dihydroxytartaric acid produced from an economical salt of this acid is brought into contact with the surfaces to be decontaminated. In order to form tartronic acid, the solution is then heated. Next, hydrogen peroxide is added to the solution, to form mesoxalic acid from the tartronic acid. In this way, mesoxalic acid is advantageously formed in the decontamination solution from an economical substance such as the sodium salt of dihydroxytartaric acid.

Suitable acids for replacing the oxalic acid also include hydroxyacetic acid and ketoacetic acid. Hydroxyacetic acid can be formed by heating from tartronic acid. Ketoacetic acid can be formed either from mesoxalic acid, by heating it, or from hydroxyacetic acid, by adding hydrogen peroxide.

The treatment of the surface with the aqueous decontamination solution may be preceded by an oxidation step, which is performed in an acidic or alkaline medium. This oxidation step is performed, for instance, in the presence of permanganate. This preliminary step makes the decontamination more successful. From one case to another, the treatment of the surface with the aqueous decontamination solution may also be preceded by a plurality of oxidation steps, in an acidic and an alkaline medium in alternation.

The oxidation solutions present after the oxidation step, which, for instance, contain permanganate, can be destroyed and neutralized with an added carbonic acid, which may be an ingredient of the aqueous decontamination solution. For instance, the aforementioned acidic or alkaline oxidation solutions can be destroyed by mesoxalic acid or tartronic acid. Oxalic acid is not required for reducing the permanganate.

After the treatment of the surface of the metal component, the decontamination solution, which may contain radioactive substances, is preferably delivered to an evaporator. There, the volume of solution to be disposed of is reduced.

For example, the solution to be disposed of may also be delivered to an ion exchanger, in which radioactive ions are retained.

Dicarbonic acids still contained in the solution to be disposed of are broken down, for instance thermally, into monocarbonic acids. An evaporator is usually used for this purpose.

If the system to be decontaminated has a closed circulation loop, then in order to increase the decontamination effect the decontamination solution can, for instance, be recirculated in the system through a cleaning apparatus during the treatment of the surface of the metal component, which is an ingredient of the system. Such a system may be the primary coolant loop, or the auxiliary system of a nuclear reactor plant.

If a single component such as a pump housing is to be decontaminated, it is placed in a container of a decontamination system. Besides the container, the decontamination system has a pump and a cleaning apparatus, which communicate through lines and form a circulation loop. The decontamination solution is recirculated in this system.

The cleaning apparatus is, for instance, an ion exchanger or a filter. The cleaning apparatus is, for instance, disposed in a bypass line that is opened only during the decontamination process.

Suitable apparatus for performing the method according to the invention, like the aforementioned decontamination system, are known in the art.

The method according to the invention for the chemical decontamination of surfaces has the particular advantage of permitting a high decontamination factor can be attained without using oxalic acid. Furthermore, even heavy metal salts are kept in solution, which precludes recontamination of the surfaces from precipitated salts that may contain radioactive isotopes. Moreover, with the acids used according to the invention, an intercrystalline change in sensitized materials which may, for instance, be located in the vicinity of welds, does not occur. Finally, the method according to the invention is also distinguished by that fact that even components made cf a plurality of different metals can be decontaminated with good success. The method according to the invention attains equally good results for all of the materials used in nuclear reactor plants, such as chromium nickel steel, chromium steels and nickel alloys.

Other features which are considered as characteristic for the invention are set forth in the appended claims.

Although the invention is illustrated and described herein as embodied in a method for chemical decontamination of the surface of a metal component in a nuclear reactor, it is nevertheless not intended to be limited to the details shown, since various modifications and structural changes may be made therein without departing from the spirit of the invention and within the scope and range of equivalents of the claims.

The method of operation of the invention, however, together with additional objects and advantages thereof will be best understood from the following description of specific embodiments when read in connection with the drawing.

BRIEF DESCRIPTION OF THE DRAWING

The drawing is a flow chart illustrating the production of various acids that can be used according to the invention and are used instead of oxalic acid.

DESCRIPTION OF THE PREFERRED EMBODIMENT

Referring now in detail to the single figure of the drawing, there are seen options for recirculation of the acids, and their production from salts.

In the drawing, salts are symbolized in the form of circles, acids as rectangles, and conversion processes as arrows. Mesoxalic acid 3 is obtained from a sodium salt 1 of mesoxalic acid by an ion exchange 2. Analogously, dihydroxytartaric acid 6 is obtained by ion exchange 5 from the sodium salt 4 of dihydroxytartaric acid. Tartronic acid 8 is obtained from the dihydroxytartaric acid 6 by thermal conversion 7. Mesoxalic acid 3 can be produced from the tartronic acid 8, by reaction 9 with added hydrogen peroxide. Hydroxyacetic acid 11 can also be obtained from the tartronic acid 8 by thermal conversion 10. Ketoacetic acid 12 can be obtained from the mesoxalic acid 3 by thermal conversion 14. Ketoacetic acid 12 can also be produced from the hydroacetic acid 11 by reaction 13 with added hydrogen peroxide.

We claim:

1. Method for the chemical decontamination of the surface of a metal component of a nuclear reactor plant, which comprises treating the surface of the metal component with an aqueous solution consisting of an aqueous part and an acid part, the acid part consisting essentially of at least one acid selected from the group consisting of ketonic carbonic acids and hydroxycarbonic acids.

2. Method according to claim 1, which comprises carrying out the treating step with an aqueous solution containing mesoxalic acid as the ketonic carbonic acid.

3. Method according to claim 1, which comprises carrying out the treating step with an aqueous solution containing dihydroxytartaric acid as the hydroxycarbonic acid.

4. Method according to claim 1, which comprises carrying out the treating step with an aqueous solution containing tartronic acid as the hydroxycarbonic acid.

5. Method according to claim 1, which comprises adding a complexing agent to the aqueous solution.

6. Method according to claim 5, which comprises adding a pyridine carbonic acid to the aqueous solution as the complexing agent.

7. Method according to claim 5, which comprises adding ethylenediaminetetraacetic acid to the aqueous solution as the complexing agent.

8. Method according to claim 1, which comprises adding hydrogen peroxide or hypophosphite to the aqueous solution.

9. Method according to claim 3, which comprises bringing an aqueous solution containing dihydroxytartaric acid into contact with the surface of the component, and subsequently heating the solution for the formation of tartronic acid.

10. Method according to claim 4, which comprises forming tartronic acid from dihydroxytartaric acid by heating, and subsequently forming the aqueous solution with the tartronic acid.

11. Method according to claim 3, which comprises producing dihydroxytartaric acid from one of its salts, in particular from its sodium salt.

12. Method according to claim 2, which comprises producing mesoxalic acid from one of its salts, in particular its sodium salt.

13. Method according to claim 11, which comprises producing dihydroxytartaric acid by ion exchange from one of its salts.

14. Method according to claim 12, which comprises producing mesoxalic acid by ion exchange from one of its salts.

15. Method according to claim 4, which comprises bringing the aqueous solution containing tartronic acid into contact with the surface of the component, and adding hydrogen peroxide to the solution to form mesoxalic acid.

16. Method according to claim 2, which comprises forming the mesoxalic acid by a reaction of tartronic acid and hydrogen peroxide.

17. Method according to claim 3, which comprises bringing the aqueous solution containing dihydroxytartaric acid into contact with the surface of the component, subsequently heating the aqueous solution to form tartronic acid, and subsequently adding hydrogen peroxide to the solution to form mesoxalic acid.

18. Method for the chemical decontamination of the surface of a metal component of a nuclear reactor plant, which comprises the steps of oxidizing in at least one medium selected from the group consisting of an acidic and an alkaline medium and then treating the surface of the component with an aqueous solution containing at least one acid selected from the group consisting of ketonic carbonic acids and hydroxycarbonic acids.

19. Method according to claim 18, which comprises performing the oxidation step in the presence of permanganate.

20. Method according to claim 18, which comprises performing the oxidation step as a plurality of oxidation steps in an acidic and an alkaline medium in alternation before treating the surfaces with the aqueous solution.

21. Method according to claim 18, which further comprises subsequently destroying and neutralizing the oxide solution with a carbonic acid that is an ingredient of the aqueous decontamination solution once the oxidation step has been performed.

22. Method for the chemical decontamination of the surface of a metal component of a nuclear reactor plant, which comprises treating the surface of the metal component with an aqueous solution containing at least one acid selected from the group consisting of ketonic carbonic acids and hydroxycarbonic acids, and subsequently destroying the aqueous solution.

23. Method according to claim 22, which comprises delivering the solution to an evaporator after treating the surface of a metal component if the solution contains radioactive substances.

24. Method according to claim 22, which comprises delivering the solution to an ion exchanger after the treatment of the surface of a metal component if the solution contains radioactive substances.

25. Method according to claim 23, which comprises thermally breaking down dicarbonic acid contained in the solution into monocarbonic acid in the evaporator.

26. Method according to claim 22, which comprises recirculating the aqueous solution in a system to be decontaminated through a cleaning apparatus during the treatment of the surface of a metal component which is a component of the system.

27. Method according to claim 22, which comprises recirculating the aqueous solution in a decontamination system through a cleaning apparatus during the treatment of the surface of a metal component used in a vessel of the decontamination system.

28. Method according to claim 22, which comprises recirculating the aqueous solution in a system to be decontaminated through an ion exchanger during the treatment of the surface of a metal component which is a component of the system.

29. Method according to claim 22, which comprises recirculating the aqueous solution in a decontamination system through an ion exchanger during the treatment of the surface of a metal component used in a vessel of the decontamination system.

30. Method according to claim 22, which comprises recirculating the aqueous solution in a system to be decontaminated through a filter during the treatment of the surface of a metal component which is a component of the system.

31. Method according to claim 22, which comprises recirculating the aqueous solution in a decontamination system through a filter during the treatment of the surface of a metal component used in a vessel of the decontamination system.

32. Method according to claim 22, which comprises recirculating the aqueous solution in a system to be decontaminated through a cleaning apparatus in a bypass line of the system during the treatment of the surface of a metal component which is a component of the system.

33. Method according to claim 22, which comprises recirculating the aqueous solution in a decontamination system through a cleaning apparatus in a bypass line of the decontamination system during the treatment of the surface of a metal component used in a vessel of the decontamination system.

34. Method according to claim 22, which comprises recirculating the aqueous solution in a system to be decontaminated through an ion exchanger in a bypass line of the system during the treatment of the surface of a metal component which is a component of the system.

35. Method according to claim 22, which comprises recirculating the aqueous solution in a decontamination system through an ion exchanger in a bypass line of the decontamination system during the treatment of the surface of a metal component used in a vessel of the decontamination system.

36. Method according to claim 22, which comprises recirculating the aqueous solution in a system to be decontaminated through a filter in a bypass line of the system during the treatment of the surface of a metal component which is a component of the system.

37. Method according to claim 22, which comprises recirculating the aqueous solution in a decontamination system through a filter in a bypass line of the decontamination system during the treatment of the surface of a metal component used in a vessel of the decontamination system.

38. Method for the chemical decontamination of the surface of a metal component of a nuclear reactor plant, which comprises treating the surface of the metal component in a single step with an aqueous solution consisting essentially of water and at least one acid selected from the group consisting of ketonic carbonic acids and hydroxycarbonic acids.

* * * * *